US006421845B1

(12) United States Patent
Bertoni

(10) Patent No.: US 6,421,845 B1
(45) Date of Patent: Jul. 23, 2002

(54) BELOW-DECK SOLAR BLANKET ROLLER ASSEMBLY

(76) Inventor: Italo Bertoni, 303 Edinborough Street, Windsor Ont (CA), N8X 3C3

( * ) Notice: Subject to any disclaimer, the term of this patent is extended or adjusted under 35 U.S.C. 154(b) by 0 days.

(21) Appl. No.: 09/848,406

(22) Filed: May 4, 2001

(30) Foreign Application Priority Data

Dec. 16, 2000 (CA) ..... 2326018

(51) Int. Cl.[7] ..... E04H 4/10
(52) U.S. Cl. ..... 4/502; 126/624
(58) Field of Search ..... 49/349, 372, 373; 4/498, 500, 502; 126/624, 626

(56) References Cited

U.S. PATENT DOCUMENTS

| | | | | | |
|---|---|---|---|---|---|
| 3,076,975 | A | * | 2/1963 | Lamb | 4/502 |
| 3,087,167 | A | * | 4/1963 | Cowan | 4/502 |
| 3,916,457 | A | * | 11/1975 | Morita | 4/502 |
| 5,913,613 | A | * | 6/1999 | Ragsdale et al. | 4/502 |

FOREIGN PATENT DOCUMENTS

| | | | | |
|---|---|---|---|---|
| DE | 28 03 517 A | | 8/1979 | |
| DE | 29 38 496 A | | 4/1980 | |
| DE | 3 026 956 | * | 2/1982 | 4/502 |
| FR | PCT/FR93/01016 | | 10/1993 | |
| FR | 2 745 842 A1 | | 3/1996 | |

* cited by examiner

*Primary Examiner*—Charles R. Eloshway
(74) *Attorney, Agent, or Firm*—Riches, McKenzie & Herbert LLP

(57) ABSTRACT

A below-deck solar blanket roller assembly is installed below the deck of a pool. The roller assembly includes a rotatable roller shaft for rolling and unrolling a solar blanket and a non-rotatable protective casing which surrounds the roller shaft. The roller assembly is intended to be installed below the deck of a pool. This invention at least partially overcomes some of the disadvantages of typical solar blanket rollers that are installed on the surface of the pool deck, such as inconvenience in moving the entire above-deck assembly away from and back to the pool area. The below-deck solar blanket roller assembly provides an aesthetically pleasing and safe alternative to solar blanket roller assemblies installed above the pool deck.

23 Claims, 7 Drawing Sheets

BELOW-DECK SOLAR BLANKET ROLLER ASSEMBLY

FIELD OF THE INVENTION

This invention relates to a solar blanket roller assembly and, in particular, a solar blanket roller assembly which is intended to be installed below the deck of a pool.

BACKGROUND OF THE INVENTION

In the past, solar blankets have been used to cover swimming pools in order to reduce the amount of heat lost from the pool. Typically, the solar blanket has a size and shape corresponding to the surface of the pool. The solar blanket is put on the surface of the pool when the pool is not in use. When the pool is intended to be used, the solar blanket is typically rolled up onto a roller shaft. Typically, there are wheels at each end of the roller shaft and the entire roller assembly is rolled along the top of the pool deck. When the solar blanket has been removed from the pool surface, the entire roller assembly is moved away from the pool area. When it is desired to place the solar blanket back onto the surface of the pool the entire roller assembly is rolled to a position adjacent to the pool surface and the solar blanket is unrolled from the roller shaft and put back onto the surface of the pool. Because the roller assembly can be operated only on the top of the pool deck, it is an inconvenience to move the entire roller assembly away from and back to the pool area. Also, with the roller assembly on top of the deck, it takes up room that could otherwise be used for other activities. Also, the roller assembly is not particularly pleasing to look at, either when the solar blanket is rolled up or when it is unrolled.

SUMMARY OF THE INVENTION

Accordingly, it is an object of this invention to at least partially overcome the disadvantages of the prior art. Thus, it is an object of this invention to provide an improved type of solar blanket roller assembly which is installed below the deck of a pool.

Accordingly, in one of its objects, this invention resides in a below-deck solar blanket roller assembly comprising: a rotatable roller shaft for rolling and unrolling a solar blanket, the shaft having first and second ends and a longitudinal axis extending in a longitudinal direction; a non-rotatable protective casing having first and second ends, wherein the casing is spaced radially from the roller shaft, surrounds the roller shaft, and extends in the longitudinal direction, and wherein the casing has an elongated opening extending in the longitudinal direction; first end support supporting the first shaft end and positioning the first shaft end inside and relative to the casing; second end shaft support supporting the second shaft end and positioning the second shaft end inside and relative to the casing; first end wall closing the first end of the casing; second end wall closing the second end of the casing; power coupler at an end of the roller shaft for receiving power from a source to rotate the roller shaft.

Further aspects of the invention will become apparent upon reading the following detailed description and drawings which illustrate the invention and preferred embodiments of the invention.

BRIEF DESCRIPTION OF THE DRAWINGS

In the drawings, which illustrate embodiments of the invention.

DETAILED DESCRIPTION OF THE PREFERRED EMBODIMENTS

Figure 7:
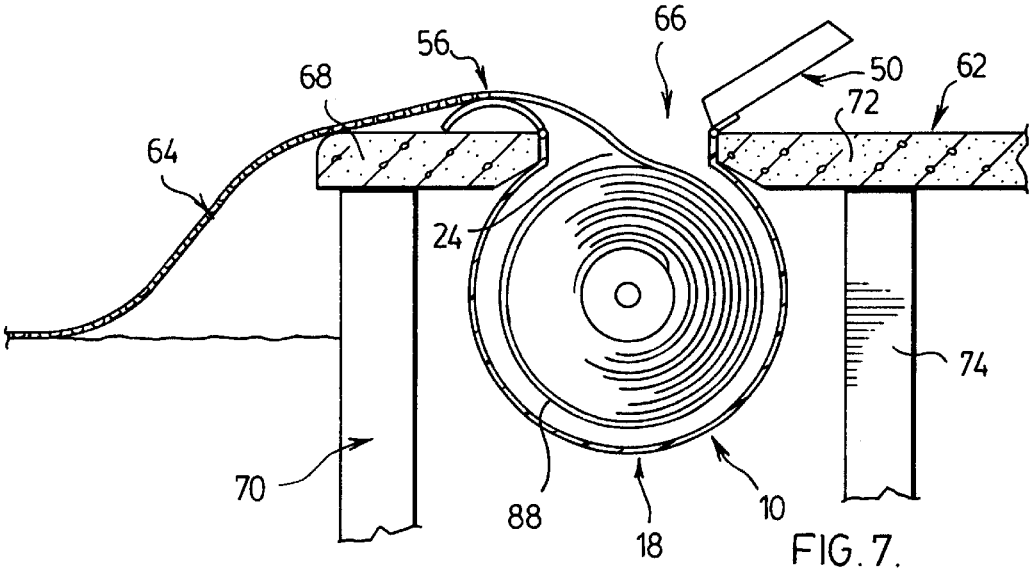
FIG. 7 is a partial cross-sectional view showing one way in which the invention may be installed.

A below-deck solar blanket roller assembly of the present invention is shown partially in FIGS. 1 and 2. The roller assembly 10 comprises a rotatable roller shaft 12 for rolling and unrolling a solar blanket 88 (as seen in FIG. 7). The solar blanket 88 is attached by suitable means, such as rivets, screws, glues, glue, touch fasteners or ties, to the roller shaft 12. The roller shaft 12 has a first end 14 and a second end 16 and a longitudinal axis LA extending in a longitudinal direction LD.

The roller assembly 10 also includes a non-rotatable protective casing 18 having a first end 20 and a second end 22.

The casing 18 is spaced radially from the roller shaft 12. The casing 18 surrounds the roller shaft 12. The casing 18 extends in the longitudinal direction LD. The casing 18 has an elongated opening 24 extending in the longitudinal direction LD. The solar blanket 88 passes through the opening 24 from the roller shaft 12 to the pool 64 (as seen in FIG. 7).

The roller assembly 10 also comprises a first end support 26 which supports the first shaft end 14 and which also positions the first shaft end 14 inside the casing 18 relative to the casing 18. Preferably the first end support 26 supports the first end 14 through a bearing assembly 28 or other suitable device to permit easy rotation of the roller shaft 12.

Similarly, there is a second end shaft support 30 supporting the second shaft end 16 and which positions the second shaft end 16 inside the casing 18 relative to the casing 18. Once again, there is a bearing assembly 32 or other suitable device to permit easy rotation of the roller shaft 12.

There is a first end wall 34 closing the first end 14 of the casing 18.

Also, there is a second end wall 36 closing the second end 16 of the casing 18.

In a preferred embodiment, the first end wall 34 sealingly closes the first end 20 of the casing 18 and the second end wall 36 sealingly closes the second end 22 of the casing. This is preferred in order to keep as much dirt and other debris as possible from entering the casing 18 after the casing 18 has been installed.

There is a power coupler 38 at an end of the roller shaft 12 for receiving power from a source to rotate the roller shaft 12.

The source of power could be human energy. For example, there could be a manual crank positioned away from the casing. A human operator would turn the crank and the crank would be suitably coupled to the power coupler 38 such as through a chain and sprocket or through suitable gears.

Figure 2:
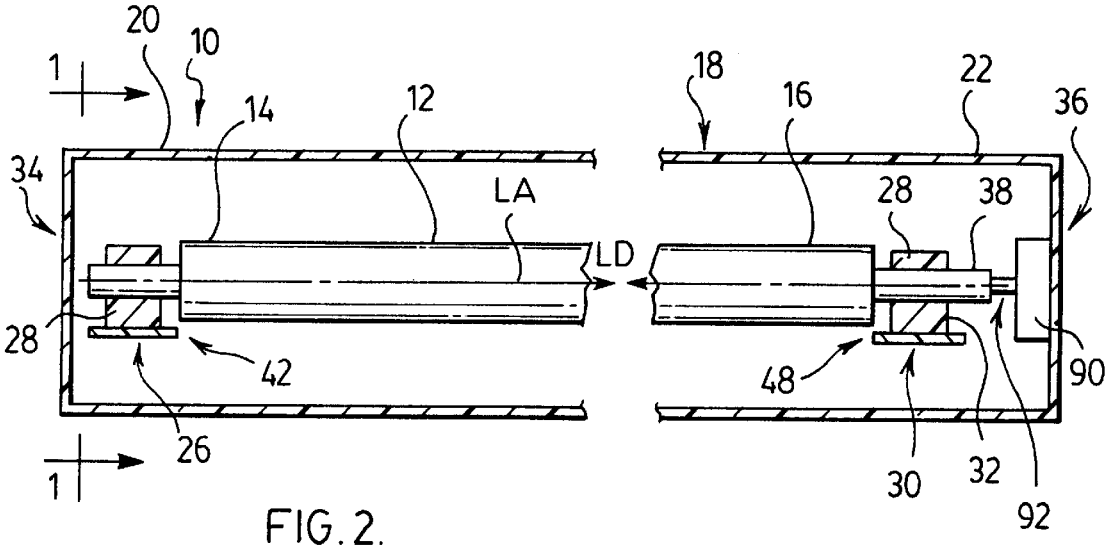
FIG. 2 is a partial sectional view along the vertical axis of an embodiment of the invention.

Alternatively, the power source could be a suitable electric motor, such as a low voltage electrical motor 90 (as shown in FIG. 2). The electric motor 90 could be positioned within the casing 18 or outside the casing 18. In either case, there would be suitable power linkage 92 from the electric motor 90 to the power coupler 38.

The power coupler 38 is any suitable power coupler, including something as simple as a hole in the end of the roller shaft 12 to receive a similarly-shaped insert from the power linkage from the power source. Also, the power coupler 38 could include a sprocket, gear, or longitudinal extender.

The casing 18 has an inner peripheral wall 40. In one embodiment of the invention, the first end support 26 comprises a first rigid support member 42 extending from a first position 44 on the inner peripheral wall 40 of the casing 18 to a second position 46 on the inner peripheral wall 40 of the casing 18.

Similarly, the second end support 30 is comprised of a similar second rigid support member 48 extending from a third position on the inner peripheral wall 40 of the casing 18 to a fourth position on the inner peripheral wall 40 of the casing 18.

Figure 1:
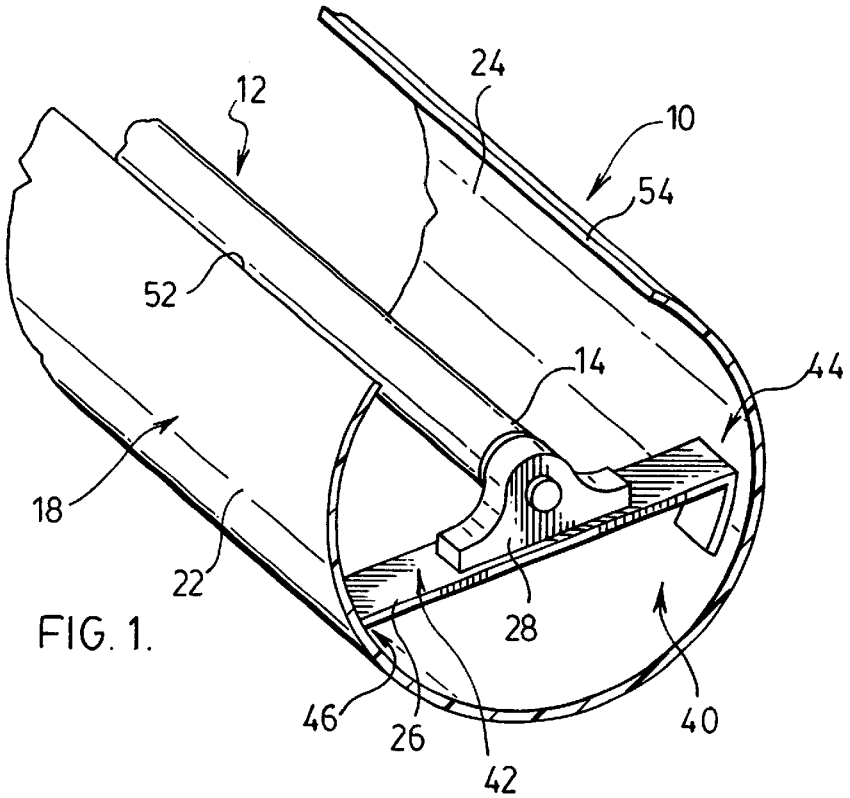
FIG. 1 is a partial prospective section view along line 1—1 as shown in FIG. 2.

Preferably, each of the rigid support members 42 and 48 is aligned in a plane parallel to a plane defined by the longitudinal axis LA and an axis orthogonal to the longitudinal axis, as for example as shown by the first rigid support member 42 in FIG. 1.

In a more preferred embodiment of the invention, each of the support members 42 and 48 is horizontal, such as the first rigid support member 42 as shown in FIG. 1.

Figure 3:
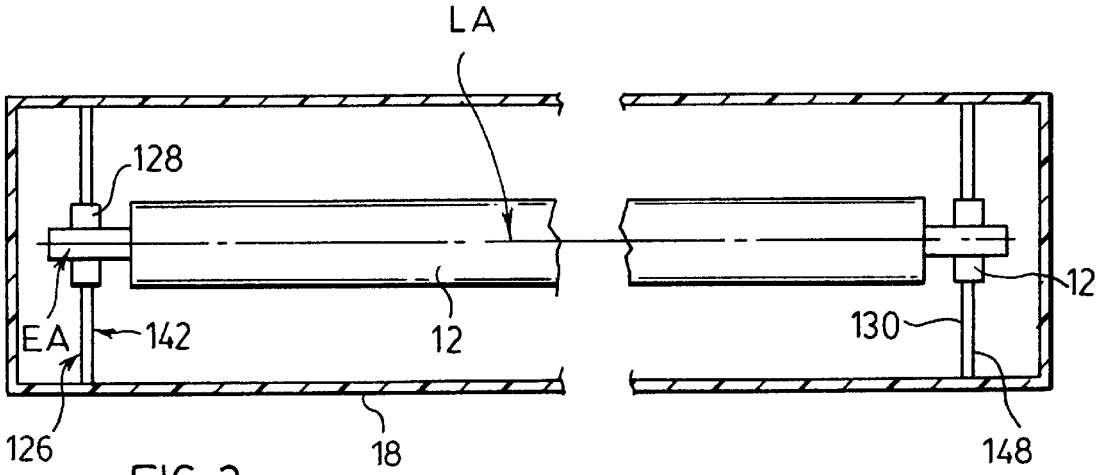
FIG. 3 is a partial sectional view along the vertical axis of another embodiment of the invention.

In an alternative embodiment, the roller shaft 12 and the casing 18 are substantially the same as discussed above and shown in FIGS. 1 and 2, however, the first end support 126 as shown in FIG. 3 is comprised of a support member 142 which is aligned in a plane defined by two axes which are orthogonal to each other and also orthogonal to the longitudinal axis LA. For example, as shown in FIG. 3, the two axes which are orthogonal to each other are the vertical axis YA and the Z axis ZA which comes transversely cut of the paper of FIG. 3.

In this embodiment, the second end support 130 similarly comprises a rigid support member 148 which is aligned in a plane defined by two axes which are orthogonal to each other and also orthogonal to the longitudinal axis.

Also, in order to have roller shaft 12 rotate most easily, each of the support members 142 and 148 support bearing assemblies 128.

Figure 4:
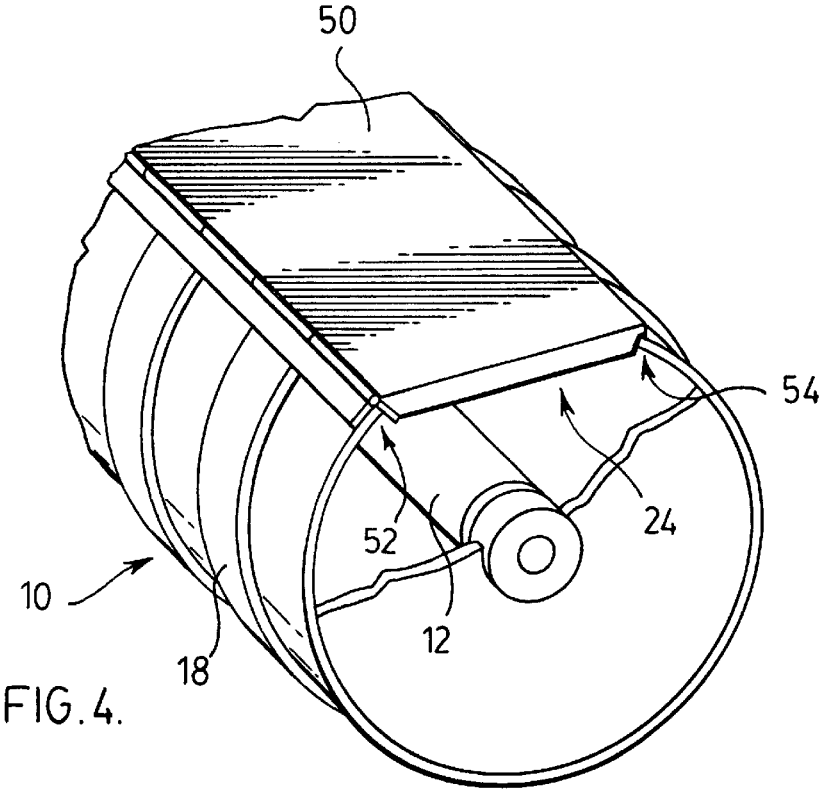
FIG. 4 is a partial, prospective, cut-away view of another embodiment of the invention.

In another embodiment, as shown in FIG. 4, there is a lid 50 associated with the casing 18. The lid 50 covers the elongated opening 24 in the casing 18. The lid 50 is movable from a first position (as shown in FIG. 4) where the elongated opening 24 in the casing 18 is closed o a second position where the lid 50 is radially outward of the casing 18 where the elongated opening 24 in the casing 18 is open (as shown in FIG. 5).

As may be seen in FIG. 1, the opening 24 in the casing 18 is defined by first edge 52 and second edge 54. As may be seen in FIG. 4, the lid 50 may be hinged to the casing 18 in the area adjacent to the first edge 52.

Figure 5:
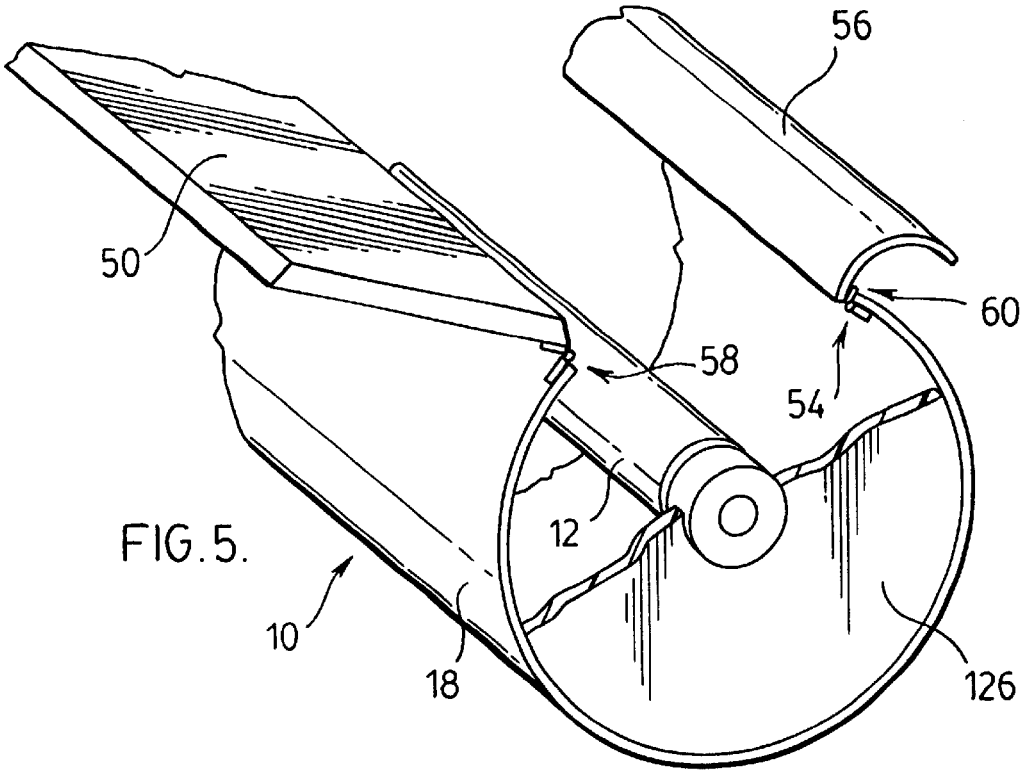
FIG. 5 is a partial, prospective, cut-away view of another embodiment of the invention.

Also, a blanket protector 56 may be hinged to the casing 18 in an area adjacent to the second edge 54 such that the blanket protector 56 rotatably moves from a first position the casing 18 to a second position radially outward from the casing 18 as shown in FIG. 5.

The blanket protector 56 protects the solar blanket 88 as the solar blanket 88 is either unwound from the roller shaft 12 or wound back up onto the roller shaft 12.

The lid 50 is moved to the open position when the operator desires to either unroll the solar blanket 88 from the roller shaft 12 and place the solar blanket over the surface of the pool or, alternatively, when an operator wants to roll the solar blanket 88 back onto the roller shaft 12. When the solar blanket is either entirely rolled onto the roller shaft 12 or when the solar blanket 88 is positioned over the pool surface, the operator will typically close the lid 50 so as to cover the elongated opening 24, primarily for safety reasons but also for aesthetic reasons.

Preferably the lid 50 has a "V" shape in cross-section so that it wedges into the opening 24 and is at least partially supported by the first and second edges 52 and 54 of the opening 24. Also, the lid 50 can be partially supported by lips 58 and 60 (as shown in FIG. 5).

In a preferred embodiment, the casing 18 is formed from plastic, corrugated pipe, primarily to provide strength and rigidity to the casing 18, as shown if FIG. 4.

Figure 6:
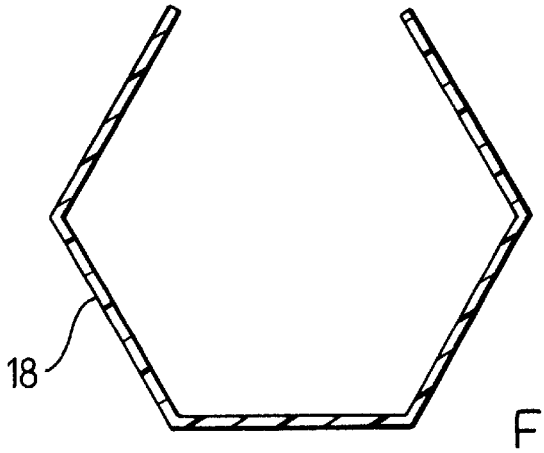
FIG. 6 is one preferred embodiment of the casing of the invention.

Alternatively, in another preferred embodiment, the casing is formed from galvanized metal. In this embodiment, the casing need not be circular in cross-section. For example, the casing 18 could have a generally hexagonal shape as shown in FIG. 6, or some other suitable cross-sectional shape.

In yet a further embodiment of the invention, the casing 18 can be formed from extruded plastic. In essence, the plastic is extruded into the desired shape of the casing 18 as shown generally in FIGS. 1 to 3. In a further preferred embodiment, the casing 18 could be extruded to include the lips 58 and 60 which are on the edges 52 and 54 of the opening 24 (as best seen in FIG. 5).

In a pool 64 that is at least partially surrounded by a deck 62, the roller assembly 10 is intended to be installed below the deck 62. In a preferred embodiment, the casing 18 is oriented such that the opening 24 in the casing 18 is aligned with an opening 66 in the deck 62. Preferably, the opening 66 in the deck 62 is spaced away from a portion of the deck 68 which is immediately adjacent to the pool 64. Preferably the portion of the deck 68 immediately adjacent to the pool 64 is supported by the pool wall 70. In a more preferred embodiment of the invention, the opening 66 in the deck is spaced between the portion of the deck 68 immediately adjacent to the pool 64 and a deck portion 72 distant from the pool 64. Preferably the deck portion 72 distant from the pool 64 is supported by a deck support 74.

Figure 8:
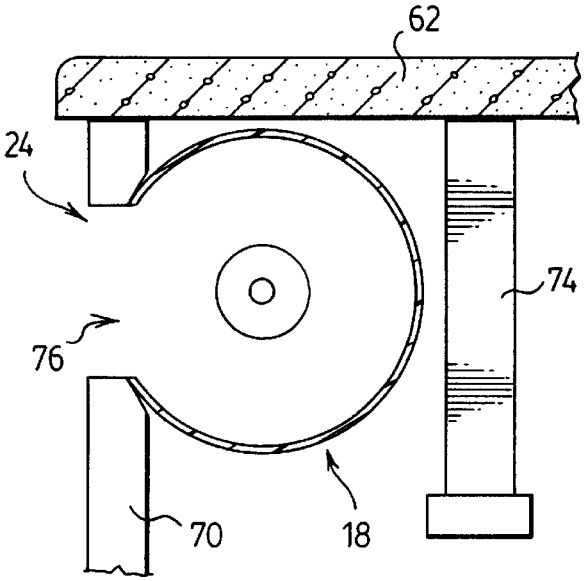
FIG. 8 is a partial cross-sectional view showing another way in which the invention may be installed.

In another embodiment of the invention, the casing 18 is oriented such that the opening 24 in the casing 18 is aligned with an opening 76 in the pool wall 70, as shown in FIG. 8.

Figure 9:
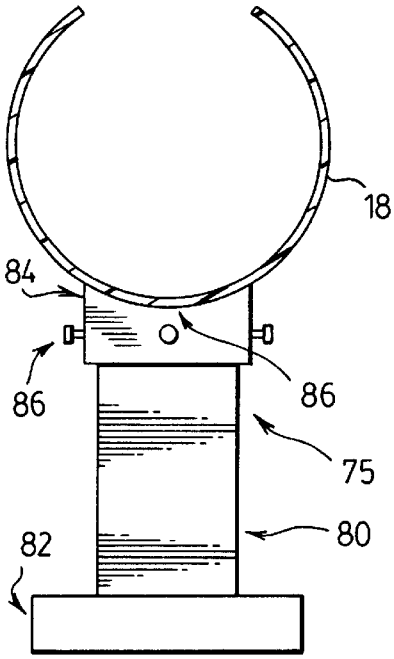
FIG. 9 is a prospective view showing some aspects of an embodiment of the invention.
Figure 10:
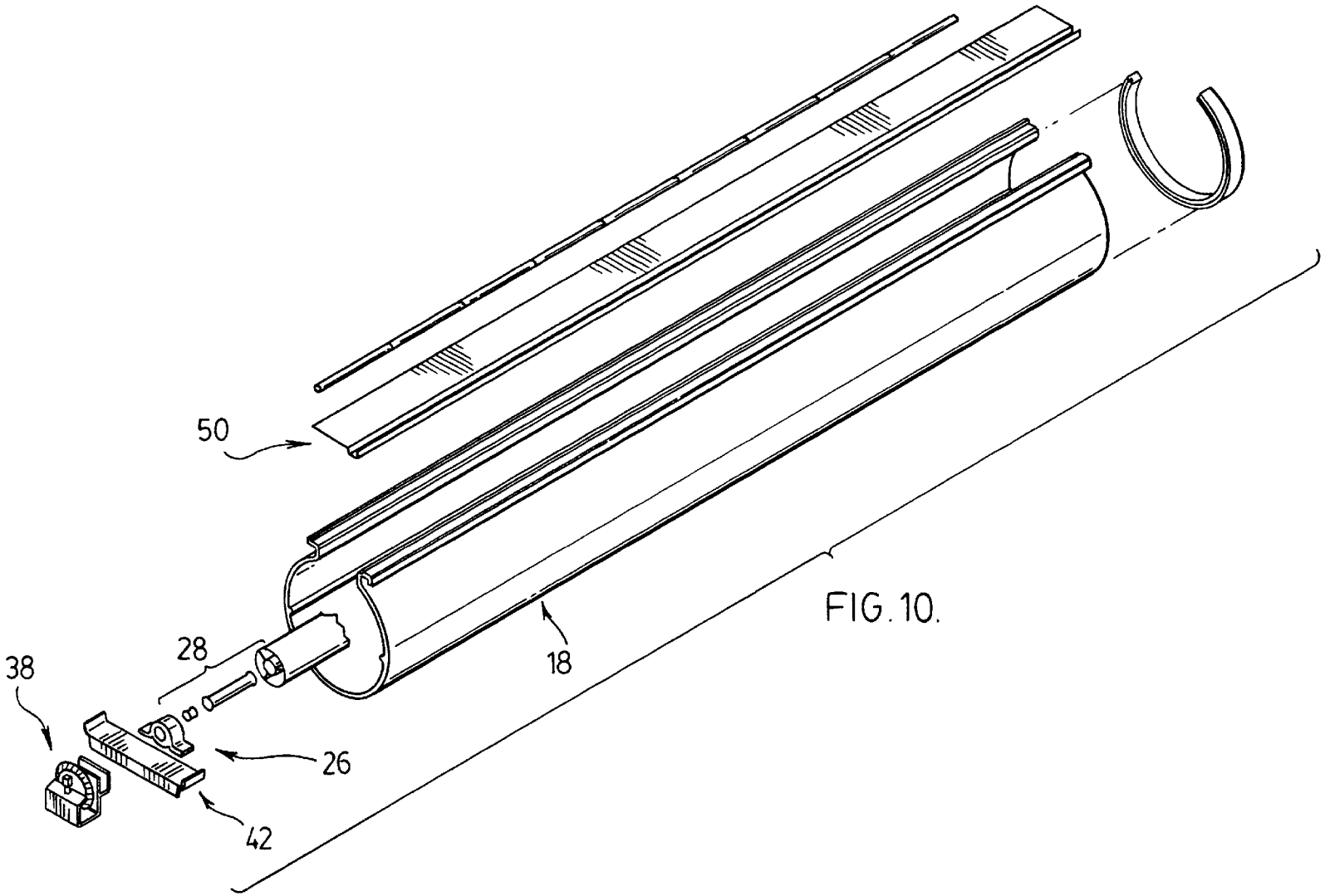
FIG. 10 is a blow-out prospective view showing some aspects of a preferred embodiment of the invention.
Figure 11:
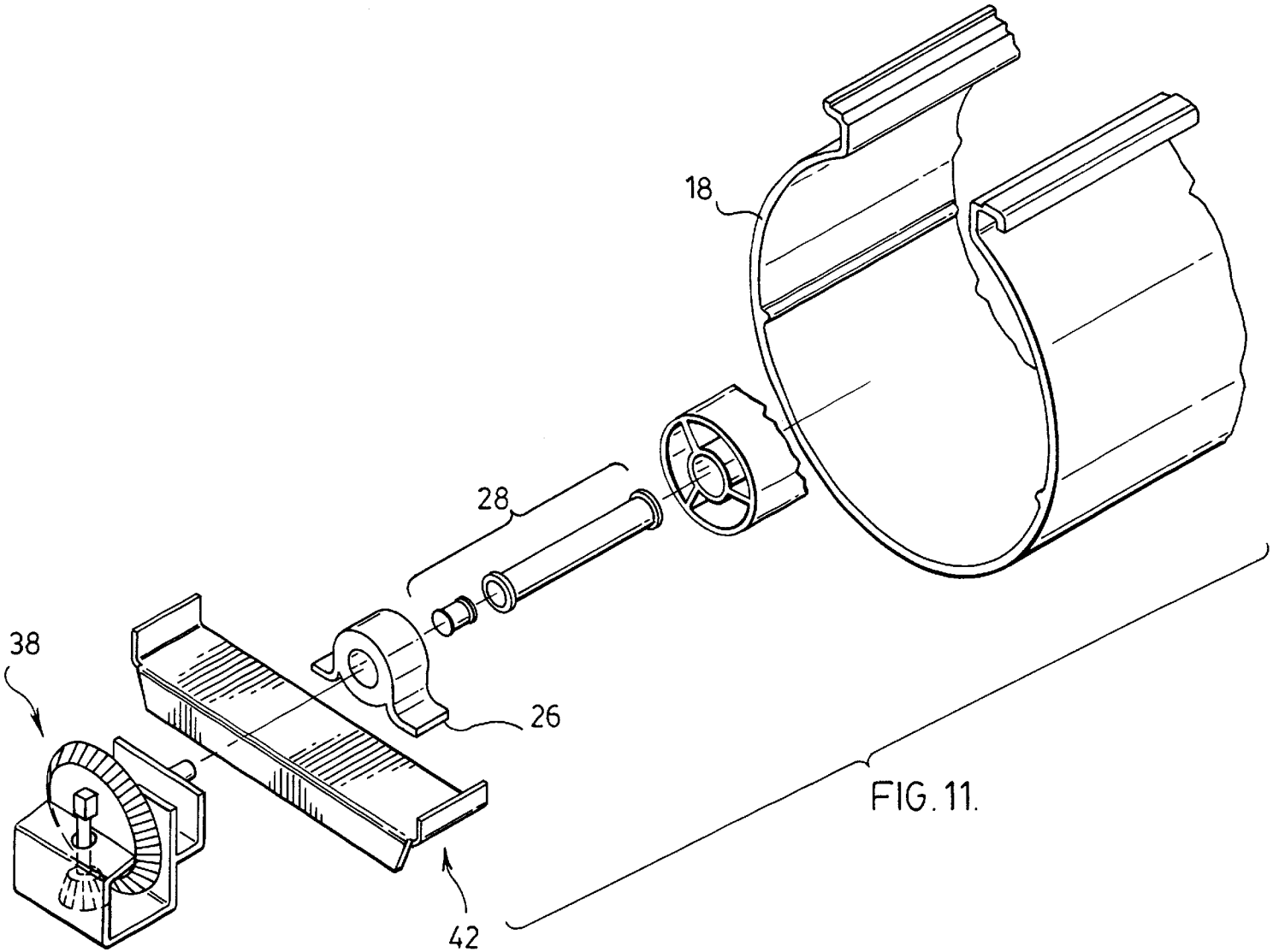
FIG. 11 is a blow-out prospective view showing some aspects of a preferred embodiment of the invention.
Figure 12:
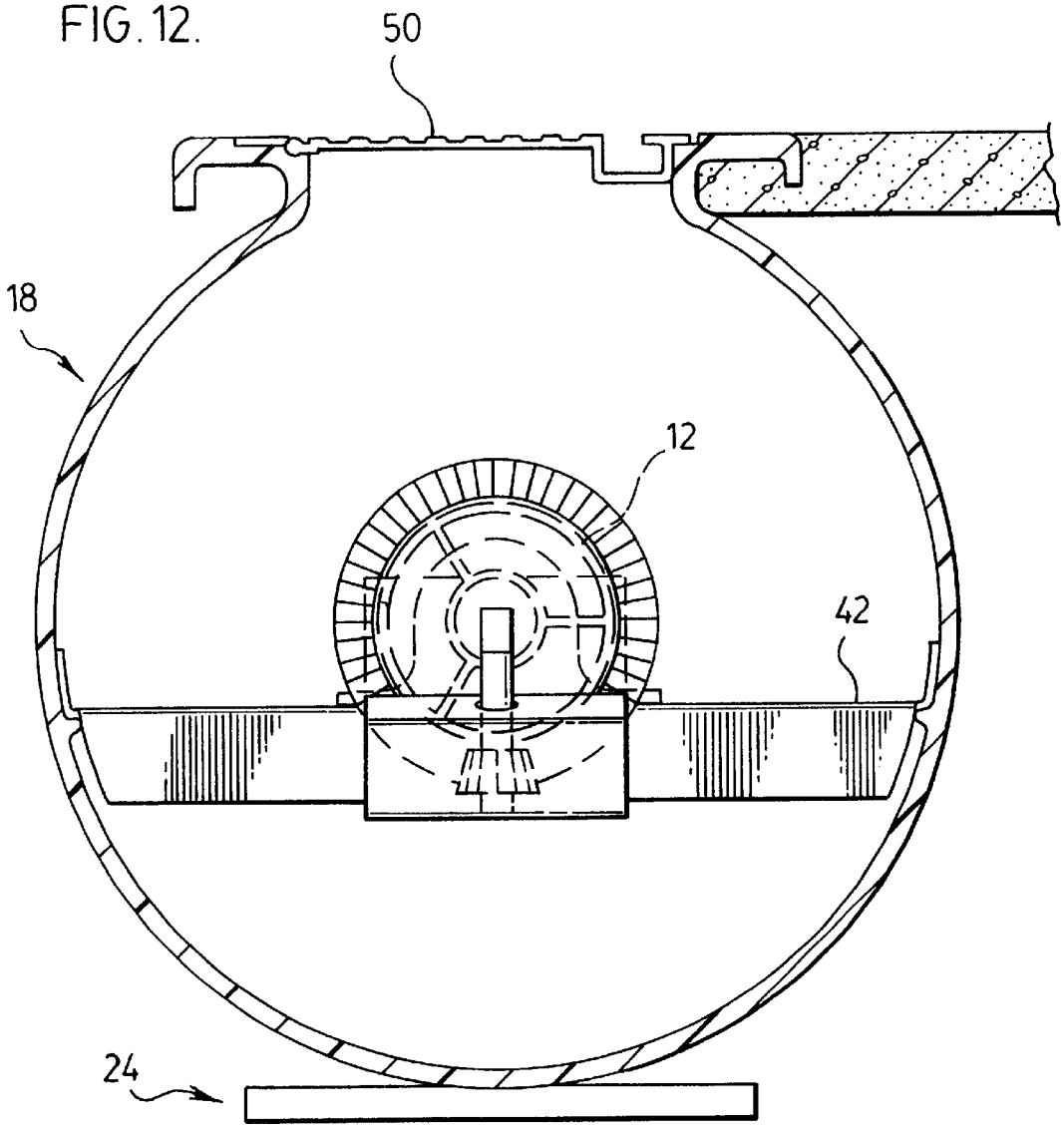
FIG. 12 is an end view of a preferred embodiment of the invention.

In a preferred embodiment of the invention, the casing is supported by a pair of casing supports 78 as shown in FIG. 9. Preferably the casing support 78 is comprised of a suitable block, concrete or brick structure underneath each of the first and second ends 20, 22 of the casing 18. For example, in FIG. 9, the casing support 78 comprises a vertical concrete support member 80. Preferably, the vertical concrete support member 80 is formed by pouring concrete into a plastic tube or sonotube. Preferably, the vertical concrete support member 80 is supported by a suitable footing 82.

The casing 18 is supported by a first casing support at the first end 20 of the casing 18 and by a second casing support at the second end 22 of the casing 18.

Preferably, each casing support 78 has a casing leveller.

In one embodiment, the casing leveller, as shown in FIG. 9, comprises a relatively short length of pipe 84 which is moveable up and down on the vertical concrete support member 80. The top portion 86 of the pipe 84 is shaped to receive the casing 18. The pipe 84 can be moved up and down on the vertical concrete support member 80 to adjust the height of the particular end 20, 22 of the casing 18. Adjustable screws 86 are tightened and forced into the vertical concrete support member 80 to fix the pipe 80 and the casing 18 at the desired height.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

The embodiments of the invention in which an exclusive property or privilege is claimed are defined as follows:

1. A below-deck solar blanket roller assembly comprising:

a rotatable roller shaft for rolling and unrolling a solar blanket, the shaft having first and second ends and a longitudinal axis extending in a longitudinal direction;

a first end support supporting the first shaft end and positioning the first shaft end inside and relative to the casing;

a second end shaft support supporting the second shaft end and positioning the second shaft end inside and relative to the casing, said first and second end supports each having first and second ends, said first and second ends suspending said first and second end supports above a bottom of the casing in a generally horizontal position;

a first end wall closing the first end of the casing;

a second end wall closing the second end of the casing;

a power coupler at an end of the roller shaft for receiving power from a source to rotate the roller shaft.

2. A roller assembly as defined in claim 1 wherein the casing has an inner peripheral wall and wherein the first end support comprises a first rigid support member extending from a first position on the inner peripheral wall of the casing to a second position on the inner peripheral wall of the casing; and wherein the second end support comprises a second rigid support member extending from a third position on the inner peripheral wall of the casing to a fourth position on the inner peripheral wall of the casing.

3. A roller assembly as defined in claim 2 wherein each of the support members is aligned in a plane parallel to a plane defined by the longitudinal axis and an axis orthogonal to the longitudinal axis.

4. A roller assembly as defined in claim 3 wherein each of the support members is horizontal and supports a bearing assembly which supports an end of the shaft.

5. A roller assembly as defined in claim 4 further comprising a lid which is moveable from a first position covering the elongated opening in the casing to a second position outwardly from the casing where the opening in the casing is open;

wherein the opening in the casing is defined by first and second edges and wherein the lid is hinged in an area adjacent to the first edge; and wherein a blanket protector is hinged in an area adjacent to the second edge such that the blanket protector rotatably moves from a first position within the opening in the casing to a second position outwardly from the casing;

wherein the casing is formed from plastic, corrugated pipe; and wherein the first end wall sealingly closes the first end of the casing and the second end wall sealingly closes the second end of the casing.

6. A roller assembly as defined in claim 1 further comprising a lid which is moveable from a first position wherein the elongated opening in the casing is covered to a second position radially outward from the casing where the elongated opening in the casing is open.

7. A roller assembly as defined in claim 6 wherein the opening in the casing is defined by first and second edges and wherein the lid is hinged to the casing in an area adjacent to the first edge; and wherein a blanket protector is hinged in an area adjacent to the second edge such that the blanket protector rotatably moves from a first position radially inward of the casing to a second position radially outward from the casing.

8. A roller assembly as defined in claim 1 wherein the casing is formed from plastic, corrugated pipe.

9. A roller assembly as defined in claim 1 wherein the casing is formed from galvanized metal.

10. A roller assembly as defined in claim 1 wherein the casing is formed from extruded plastic.

11. A roller assembly as defined in claim 1 wherein the first end wall sealingly closes the first end of the casing and the second end wall sealingly closes the second end of the casing.

12. A roller assembly as defined in claim 1 wherein said drive assembly is coupled to an electric motor as a source of power.

13. In a pool at least partially surrounded by a deck, a solar blanket roller assembly installed below the deck, comprising:

a rotatable roller shaft for rolling and unrolling a solar blanket, the shaft having first and second ends and a longitudinal axis extending in a longitudinal direction;

a non-rotatable protective casing having first and second ends, wherein the casing is spaced radially from the roller shaft, surrounds the roller shaft, and extends in the longitudinal direction, and wherein the casing has an elongated opening extending in the longitudinal direction;

a first end support supporting the first shaft end and positioning the first shaft end inside and relative to the casing;

a second end shaft support supporting the second shaft end and positioning the second shaft end inside and relative to the casing, said first and second end supports each having first and second ends, said first and second ends suspending said first and second end supports above a bottom of the casing in a generally horizontal position;

a first end wall closing the first end of the casing;

a second end wall closing the second end of the casing;

a drive assembly disposed towards an end of the roller shaft for imparting rotational energy to selectively rotate the roller shaft.

14. A roller assembly as defined in claim 13 wherein the casing is oriented such that the opening in the casing is aligned with an opening in an upper part of a wall of the pool.

15. A roller assembly as defined in claim 13 wherein the casing is oriented such that the opening in the casing is aligned with an opening in the deck.

16. A roller assembly as defined in claim 15 wherein the opening in the deck is spaced away from a portion of the deck immediately adjacent to the pool.

17. A roller assembly as defined in claim 16 wherein the portion of the deck immediately adjacent to the pool is supported by the pool wall.

18. A roller assembly as defined in claim 17 wherein the opening in the deck is spaced between a portion of the deck immediately adjacent to the pool and a deck portion distant from the pool; and wherein the deck portion distant from the pool is supported by a deck support;

wherein the casing is supported by a first casing support at the first end of the casing and by a second casing support at the second end of the casing; and wherein each casing support has a casing leveler.

19. A roller assembly as defined in claim 15 wherein the opening in the deck is spaced between a portion of the deck immediately adjacent to the pool and a deck portion distant from the pool; and wherein the deck portion distant from the pool is supported by a deck support.

20. A roller assembly as defined in claim 13 wherein the casing is supported by a first casing support at the first end of the casing and by a second casing support at the second end of the casing.

21. A roller assembly as defined in claim 20 wherein each casing support has a casing leveler.

22. A roller assembly as defined in claim 13 wherein the casing has an inner peripheral wall and wherein the first end support comprises a first rigid support member extending from a first position on the inner peripheral wall of the casing to a second position on the inner peripheral wall of the casing; and wherein the second end support comprises a second rigid support member extending from a third position on the inner peripheral wall of the casing to a fourth position on the inner peripheral wall of the casing;

wherein each of the support members is aligned in a plane parallel to a plane defined by the longitudinal axis and an axis orthogonal to the longitudinal axis;

wherein each of the support members is horizontal and supports a bearing assembly which supports an end of the shaft;

further comprising a lid which is moveable from a first position wherein the elongated opening in the casing is covered to a second position radially outward from the casing where the elongated opening in the casing is open;

wherein the opening in the casing is defined by first and second edges and wherein the lid is hinged to the casing in an area adjacent to the first edge; and wherein a blanket protector is hinged in an area adjacent to the second edge such that the blanket protector rotatably moves from a first position radially inward of the casing to a second position radially outward from the casing;

wherein the casing is formed from plastic, corrugated pipe; and wherein the first end wall sealingly closes the first end of the casing and the second end wall sealingly closes the second end of the casing.

23. A below-deck solar blanket roller assembly comprising:

a rotatable roller shaft for rolling and unrolling a solar blanket, the shaft having first and second ends and a longitudinal axis extending in a longitudinal direction;

a first end support supporting the first shaft end and positioning the first shaft end inside and relative to the casing;

a second end shaft support supporting the second shaft end and positioning the second shaft end inside and relative to the casing;

a first end wall closing the first end of the casing;

a second end wall closing the second end of the casing;

a power coupler at an end of the roller shaft for receiving power from a source to rotate the roller shaft;

a lid which is moveable from a first position covering the elongated opening in the casing to a second position outwardly from the casing where the opening in the casing is open, wherein the opening in the casing is defined by first and second edges and wherein the lid is hinged in an area adjacent to the first edge; and wherein a blanket protector is hinged in an area adjacent to the second edge such that the blanket protector rotatably moves from a first position within the opening in the casing to a second position outwardly from the casing;

wherein the casing is formed from galvanized metal; and wherein the first end wall sealingly closes the first end of the casing and the second end wall sealingly closes the second end of the casing.

* * * * *